United States Patent [19]

Cote

[11] 4,443,666

[45] Apr. 17, 1984

[54] ELECTRET MICROPHONE ASSEMBLY

[75] Inventor: Paul L. Cote, Windham, N.H.

[73] Assignee: Gentex Corporation, Carbondale, Pa.

[21] Appl. No.: 209,519

[22] Filed: Nov. 24, 1980

[51] Int. Cl.[3] ..... H04R 19/01; H04R 19/04

[52] U.S. Cl. ..... 179/111 E

[58] Field of Search ..... 179/111 E, 140, 141, 179/111 R, 121 D, 121 R, 121 C, 107 E, 107 FD, 107 R, 107 S; 361/395, 399, 404

[56] References Cited

U.S. PATENT DOCUMENTS

| | | | |
|---|---|---|---|
| 3,396,313 | 8/1968 | Payne | 361/395 |
| 3,436,492 | 4/1969 | Reedyk | 179/111 E |
| 4,046,974 | 9/1977 | Baumhauer et al. | 179/111 R |
| 4,331,840 | 5/1982 | Murphy et al. | 179/111 E |

FOREIGN PATENT DOCUMENTS

| | | | |
|---|---|---|---|
| 2318067 | 4/1973 | Fed. Rep. of Germany | 179/111 E |
| 2909065 | 9/1979 | Fed. Rep. of Germany | 179/111 E |
| 726675 | 4/1980 | U.S.S.R. | 179/111 E |

*Primary Examiner*—Stafford D. Schreyer
*Attorney, Agent, or Firm*—Shenier & O'Connor

[57] ABSTRACT

An electret microphone assembly in which an insulating support disposed between the apertured front and back walls of a conductive housing has an enclosed portion contained in the housing and an exposed portion extending out of the housing through an opening formed in the side wall thereof. The support carries the back electrode of an electret microphone on the front of the enclosed portion and an FET amplifier circuit on the back of the same portion. Respective electrical contacts formed on the back of the exposed portion of the support extend inwardly through the side opening in the housing to provide external connections to the source and drain of the FET and to the amplifier common line.

8 Claims, 5 Drawing Figures

Fig 1
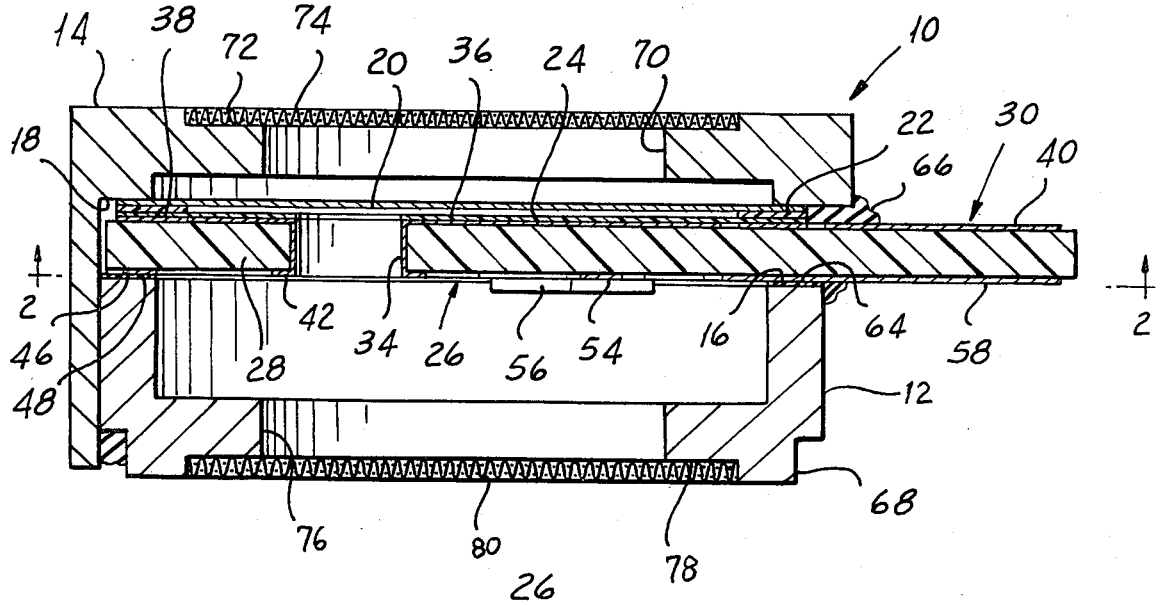
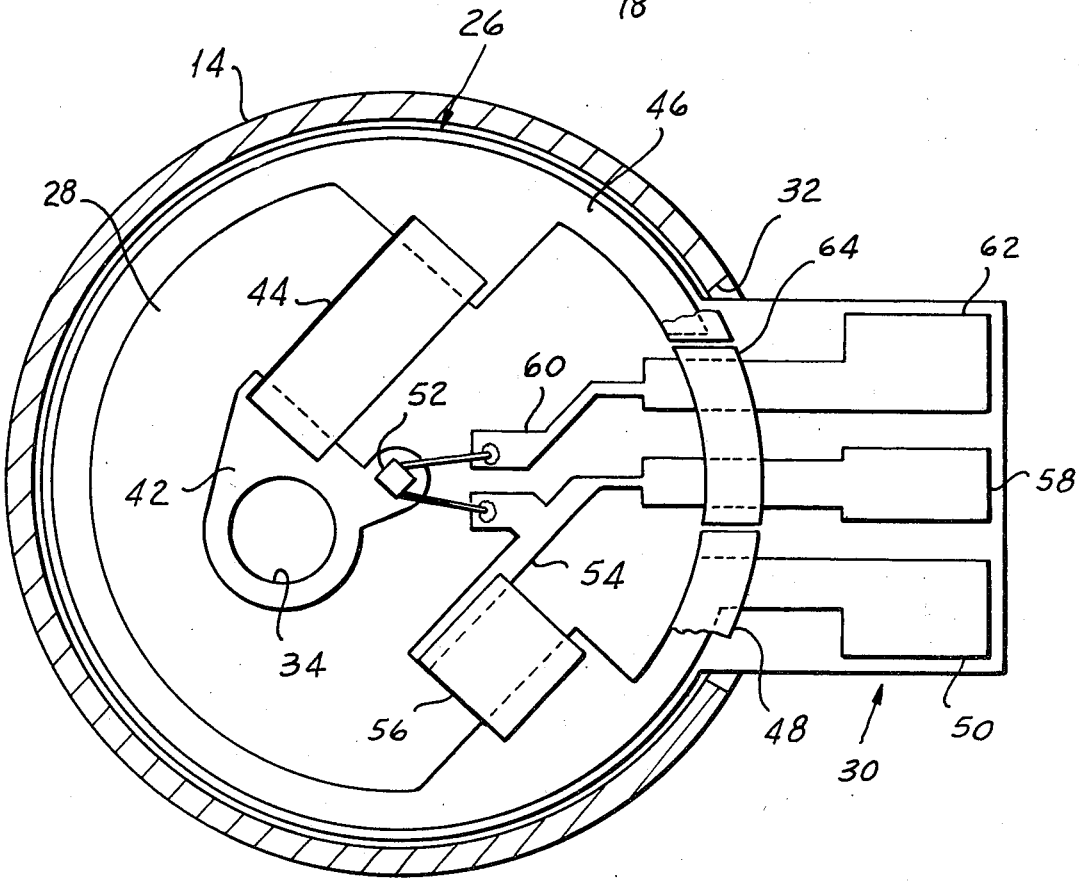
Fig 2

ELECTRET MICROPHONE ASSEMBLY

BACKGROUND OF THE INVENTION

Capacitor microphones in which a permanently polarized dielectric, or electret, is used to obviate the need for an external high-voltage supply are well known in the art. Because of their small size, relative insensitivity to temperature or humidity changes, and extended high-frequency response, they are especially suited for use in citizen's band transceivers, military communications systems, and the like. Because of their relatively low output, however, electret microphones require a local preamplifier circuit which must be well shielded to avoid external electromagnetic interference.

Fraim et al U.S. Pat. No. 3,816,671 describes an electret microphone assembly in which a first insulating support disposed between the front and back walls of a conductive housing carries the back electrode of the electret microphone, while a second insulating support forming the back wall of the housing carries a preamplifier circuit on the front or inside surface thereof. The outside surface of the second support carries the voltage supply and output terminals of the preamplifier and is metallized over most of the remainder of the surface area to provide electrostatic shielding.

While the patentees claim to be successful in accomplishing the objects of their invention, their microphone assembly does have some drawbacks. The use of separate supports to support the electromechanical and electronic components, respectively, adds to the complexity and expense of their overall assembly. Further, the use of a metallized insulating support both as an amplifier support and as a back wall of the housing exposes the amplifier to physical shock and to electromagnetic interference. The use of the back wall as an amplifier support also makes it impractical to provide a rear port to render the microphone responsive to velocity rather than pressure when directionality is desired.

In another type of electret microphone assembly known to the art, a single insulating support disposed between the back and the front of the conductive housing carries the back electrode of the electret microphone on its front surface and carries a preamplifier circuit on its rear surface. A coaxial cable entering the housing through an aperture formed in the back wall thereof has its inner conductor coupled to the preamplifier output to provide an external connection. While this arrangement is somewhat simpler than the arrangement disclosed by Fraim et al and better shields the amplifier circuit, it likewise rules out the provision of a rear port to give the microphone a directional response characterisic.

SUMMARY OF THE INVENTION

One of the objects of my invention is to provide an electret microphone asssembly which is simple and inexpensive to manufacture.

Another object of my invention is to provide an electret microphone assembly which is easy to install and replace in existing equipment.

Still another object of my invention is to provide an electret microphone assembly which minimizes pickup of unwanted ambient sounds.

A further object of my invention is to provide an electret microphone assembly which effectively shields the microphone and associated amplifier circuit from electromagnetic interference.

A still further object of my invention is to provide an electret microphone assembly which protects the amplifier from the external physical environment.

Other and further objects will be apparent from the following description.

In general, my invention contemplates an electroacoustic transducer in which an insulating support having an enclosed portion contained in a housing and an exposed portion extending out of the housing through an opening formed therein carries the back electrode of an electret microphone on the front of the enclosed portion and an amplifier circuit on the back of the same portion. The amplifier has its input coupled to the electrode and its output coupled to an electrical contact formed on the exposed portion of the support.

BRIEF DESCRIPTION OF THE DRAWINGS

In the accompanying drawings which form part of the instant specification and which are to be read in conjunction therewith and in which like reference numerals indicate like parts in the various views:

FIG. 1 is a section of a preferred embodiment of my microphone assembly in which the housing is formed with a rear port to provide a directional response.

FIG. 2 is a section of the microphone assembly shown in FIG. 1, taken along line 2—2.

DESCRIPTION OF THE PREFERRED EMBODIMENTS

Figure 3:
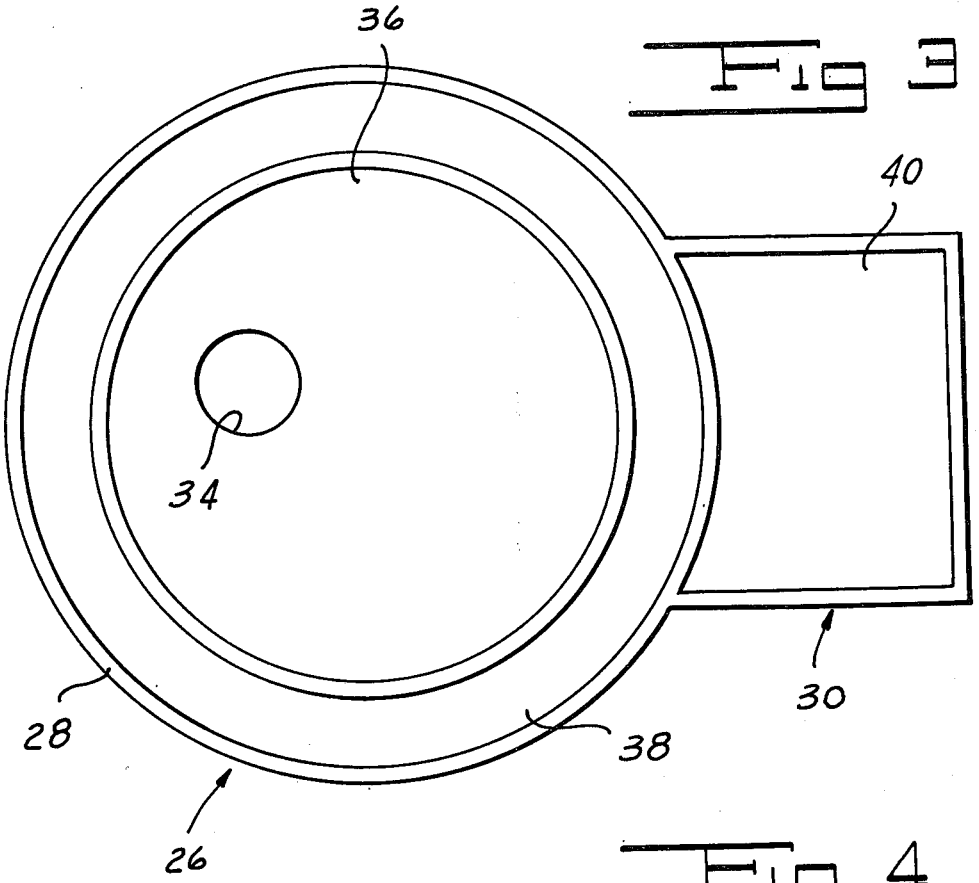
FIG. 3 is a front elevation of the printed circuit board of the microphone assembly of FIG. 1, shown in an intermediate stage of construction with the electret removed.

Referring now to FIGS. 1 to 4, a preferred embodiment of my microphone assembly, indicated generally by the reference numberal 10, functions as a velocity microphone that is sensitive to sounds originating from along the axis of the microphone but relatively insensitive to sound originating off axis. More particularly, the microphone assembly 10 includes a conductive base or rear housing portion 12, shown at the bottom in FIG. 1, and a conductive cap or front housing portion 14 which fits over the base 12 in intimate sliding contact therewith as shown in FIG. 1 to form a conductive housing. Cap 14 is formed with a front port 70 and with a larger-diameter recess 72 at the front of port for receiving a wire screen 74. Likewise, base 12 is formed with a back port 76 and with a larger-diameter recess 78 at the rear of port 76 for receiving a wire screen 80. A circuit board indicated generally by the reference numeral 26 includes a generally disk-shaped portion supported by the front rim 16 of base 12 inside the housing and a rectangularly shaped exposed portion or tab 30 which extends out of the housing through a slot 32 formed in the sidewall of cap 14. A non-conductive outer epoxy seal 66 extends along the lower edge of cap 14 and along the interface between tab portion 30 and base 12. Preferably base 12 is formed with an indentation 68 around its rear periphery to accommodate the epoxy seal 66.

Circuit board 26, which supports the transducer and electronic elements of the microphone assembly 10, is formed from an insulating support 28 having a circular electrode 36 formed on the front surface of the circular or enclosed portion of the board 26, as shown in FIG. 3. A permanently polarized disk-shaped electret 24 comprising a tetrafluoroethylene polymer or the like is in turn bonded to the front surface of the electrode 36. A support ring 38 formed concentrically around electrode 36 on the board 26 supports the periphery of the electret 24. Electret 24 in turn supports an annular polyester spacer 22 to which is bonded a polyester diaphragm 20 having a gold plating (not separately shown) on the front surface thereof. Electrode 36, electret 24, spacer 22 and diaphragm 20 together constitute the transducer element of the assembly 10. An annular shoulder 18 formed from the inner surface of cap 14 presses the diaphragm 20 and spacer 22 against support ring 38 to sandwich the board 26 between the upper rim 15 of base 12 and spacer 22.

Board 26 is also formed with an aperture 34 having a conductive plating formed on the walls thereof to couple electrode 36 electrically to a plated area 42 on the back surface of the board 26. I also form electret 24 with an aperture in registry with aperture 34 to provide an acoustic coupling between the two sides of board 26. Plated area 42 is connected to the gate electrode of a field-effect transistor or FET 52 carried on the rear of board 26. Transistor 52 has its source electrode coupled to a conductive strip 54 formed on the rear of board 26 and its drain electrode to a conductive strip 60 also formed on the rear of board 26. A gate resistor 44 provides a conductive path between the gate strip or area 42 and an annular peripheral strip 46 formed on the rear of board 26, while a source resistor 56 coupled the source strip 54 to the same strip 46.

A first electrical terminal or contact 50 is formed on the rear of tab portion 30 extends inwardly through the slot 32 to join annular strip 46. Similarly, a second electrical terminal 58 formed on the rear of tab portion 30 extends through slot 32 to join the source strip 54. Finally, a third terminal 62 formed on the rear of tab portion 30 extends inwardly through slot 32 to join the drain strip 60. A conductive epoxy layer or strip 48 which is generally coextensive with annular strip 46 couples strip 46 electrically to base 12 and hence cap 14 to allow the strip 46 to serve as a ground or common line. In the embodiment shown, tab 30 also carries a plating 40 on the front surface thereof which is isolated electrically from the other portions of the assembly 10.

Figure 4:
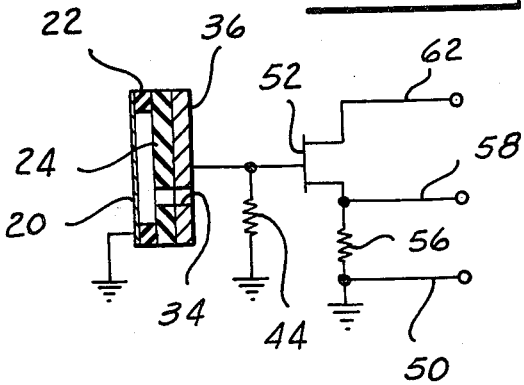
FIG. 4 is a schematic diagram of the electrical components of the microphone assembly shown in FIG. 1.

From the above description it will be apparent that terminal 50 provides an external connection to the common strip 46, while terminals 58 and 62 provide external connections to the source and drain, respectively, of FET 52, as shown in FIG. 4. A nonconductive epoxy layer 64 separates the inwardly extending portions of terminals 58 and 62 from the rim 16 to preclude the possibility of a short circuit.

Figure 5:
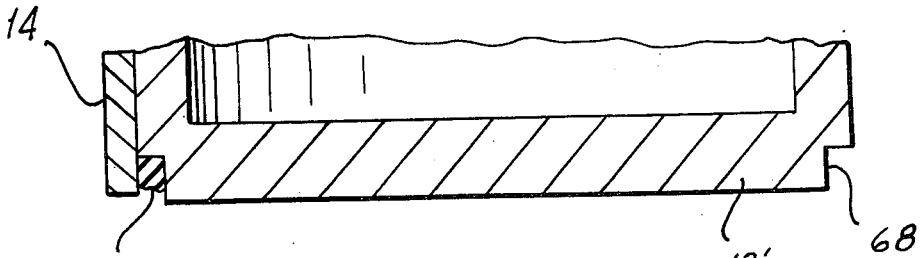
FIG. 5 is a fragmentary section of an alternative embodiment of my microphone assembly in which the rear of the housing is sealed to provide an omnidirectional response.

While my invention is particularly advantageous in a microphone assembly in which the base or rear housing portion is perforated to provide a velocity-sensitive, or directional, response characteristic, it is also within the scope of my invention to use an unperforated rear portion to provide a pressure-sensitive, or omnidirectional response. In FIG. 5 I show such an alternative construction employing an unperforated base 12' rather than the perforated base 12 shown in FIG. 1.

It will be seen that I have accomplished the objects of my invention. My electret microphone assembly is simple and inexpensive to manufacture, and is easy to install and replace in existing equipment. Further, my electret microphone assembly minimizes pickup of unwanted ambient sounds and effectively shields the microphone and associated amplifier circuit from electromagnetic interference. Finally, my assembly protects the amplifier from the external physical environment.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. A microphone including in combination a housing having an opening formed therein, an insulating support having a back and a front, said support having an enclosed portion contained in said housing and an exposed portion extending out of said housing through said opening, an electrode formed on the front of said enclosed portion, a conductive diaphragm spaced in front of said electrode, an electret disposed between said electrode and said diaphragm, an amplifier circuit carried on the back of said enclosed portion, said amplifier having an input and an output, means forming an electrical contact on the exposed portion of said support, means coupling said electrode to said input, and means coupling said output to said electrical contact.

2. A microphone including in combination a housing having an opening formed therein, an insulating support having a back and a front, said support having an enclosed portion contained in said housing and an exposed portion extending out of said housing through said opening, an electret transducer element carried on the front of said support, means forming an electrical contact on the exposed portion of the back of said support, an amplifier carried on the back of said enclosed portion, means coupling said transducer element to said amplifier, and means coupling said amplifier to said electrical contact.

3. A microphone including in combination a housing having an opening formed therein, an insulating support having a back and a front, said support having an enclosed portion contained in said housing and an exposed portion extending out of said housing through said opening, an electret transducer element carried on the front of said enclosed portion, means forming an electrical contact on the exposed portion of said support, an amplifier carried on the back of said enclosed portion, means coupling said transducer element to said amplifier, and means coupling said amplifier to said electrical contact.

4. A microphone including in combination a housing having apertured rear and front portions and an opening formed therein intermediate said portions, an insulating support having a back and a front respectively adjacent said rear and front portions, said support having an enclosed portion contained in said housing and an exposed portion extending out of said housing through said opening, an electret transducer element carried on the front of said enclosed portion, means forming an electrical contact on the exposed portion of said support, and means coupling said transducer element to said electrical contact.

5. A microphone including in combination a housing having an opening formed therein, an insulating support havng a back and a front, said support having an enclosed portion contained in said housing and an exposed portion extending out of said housing through said opening, an electret transducer element carried on the front of said enclosed portion, means forming an electrical contact on the exposed portion of said support, and means coupling said transducer element to said electrical contact.

6. A microphone as in claim 5 in which said housing is conductive.

7. A microphone as in claim 5 in which said enclosed portion cooperates with said housing to form a chamber adjacent the back of said support.

8. A microphone as in claim 7 in which said enclosed portion is formed with an aperture coupling said transducer element to said chamber.

* * * * *

UNITED STATES PATENT AND TRADEMARK OFFICE

CERTIFICATE OF CORRECTION

PATENT NO. : 4,443,666

DATED : April 17, 1984

INVENTOR(S) : Paul L. Cote

It is certified that error appears in the above-identified patent and that said Letters Patent are hereby corrected as shown below:

Column 4, line 41, "support" should read

-- enclosed portion --.

Signed and Sealed this

*Twenty-eighth* Day of *August 1984*

[SEAL]

*Attest:*

GERALD J. MOSSINGHOFF

*Attesting Officer*

*Commissioner of Patents and Trademarks*